US007651245B2

(12) United States Patent
Thomas et al.

(10) Patent No.: US 7,651,245 B2
(45) Date of Patent: Jan. 26, 2010

(54) LED LIGHT FIXTURE WITH INTERNAL POWER SUPPLY

(75) Inventors: James Thomas, Tierra Verde, FL (US); David Lynd, Seminole, FL (US); Gary Gatesman, Indian Rocks Bch., FL (US); Jim Mosier, St. Petersburg, FL (US); Bryan T. Warner, St. Pete, FL (US)

(73) Assignee: ElectraLED, Inc., Largo, FL (US)

( * ) Notice: Subject to any disclaimer, the term of this patent is extended or adjusted under 35 U.S.C. 154(b) by 101 days.

(21) Appl. No.: 11/818,216

(22) Filed: Jun. 13, 2007

(65) Prior Publication Data

US 2008/0310162 A1 Dec. 18, 2008

(51) Int. Cl.
*F21V 29/00* (2006.01)

(52) U.S. Cl. ..... 362/294; 362/249.02; 362/373

(58) Field of Classification Search ..... 362/249, 362/252, 294, 373, 800, 249.1, 249.02
See application file for complete search history.

(56) References Cited

U.S. PATENT DOCUMENTS 7,274,302 B2 * 9/2007 Stevenson et al. ..... 340/815.45
7,431,477 B2 * 10/2008 Chou et al. ..... 362/240
7,438,448 B2 * 10/2008 Chen ..... 362/373
2005/0128752 A1 * 6/2005 Ewington et al. ..... 362/294
2008/0212333 A1 * 9/2008 Chen ..... 362/373

* cited by examiner

*Primary Examiner*—Thomas M Sember
(74) *Attorney, Agent, or Firm*—McDermott Will & Emery LLP

(57) ABSTRACT

The invention provides a light fixture that includes a light engine, a rugged housing, and an internal power module that is thermally isolated. The light fixture includes several novel heat management features designed to thermally isolate the power supply in order to reduce the risk of failure and thereby increase the reliability of the light fixture. The light engine includes groups of light modules, each having a light emitting diode (LED) and a zener diode. The power module resides within a rear receptacle of the housing and includes a power supply, a box, and a cover that enclose the power supply. The housing also includes an arrangement of external fins that dissipate heat generated by the light engine. During operation, heat is generated by the light modules, namely the LEDs, and then is transferred along a flow path through a main body portion of the housing and the fins for dissipation to ambient without negatively impacting the power supply.

28 Claims, 6 Drawing Sheets

FIG. 1
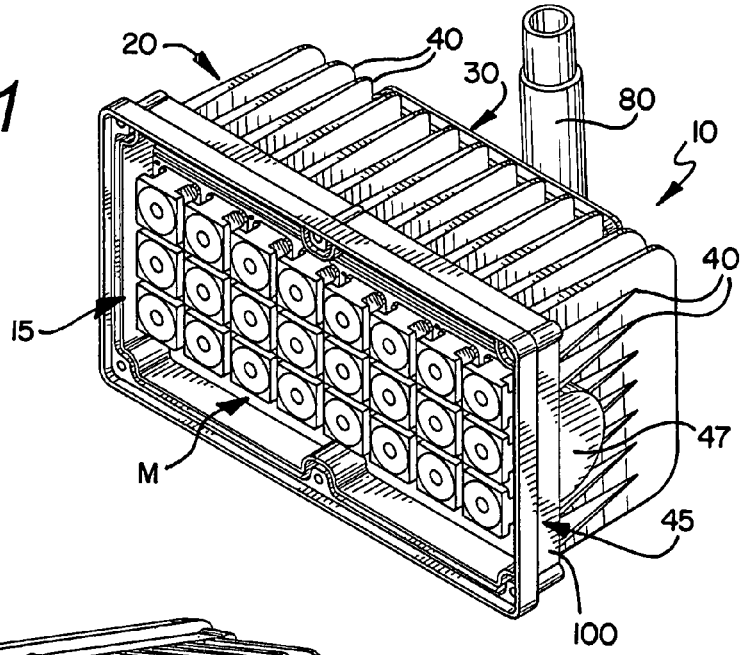
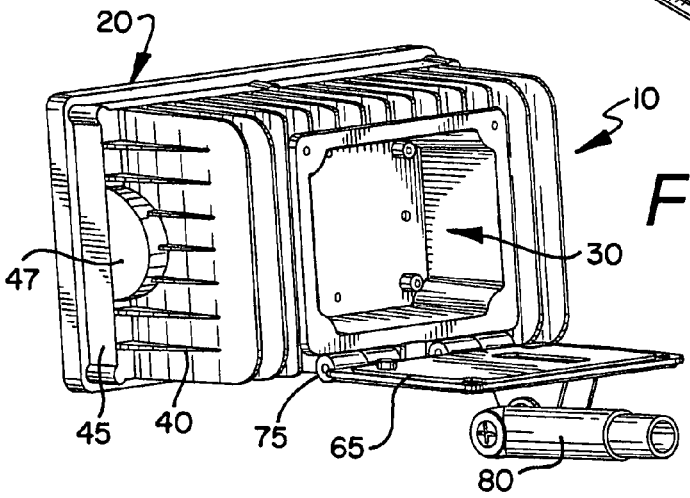
FIG. 2
FIG. 3
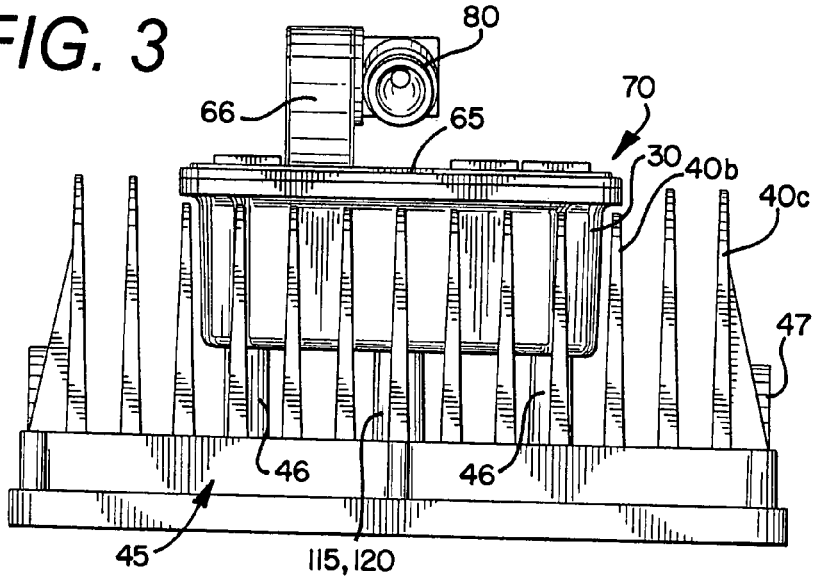

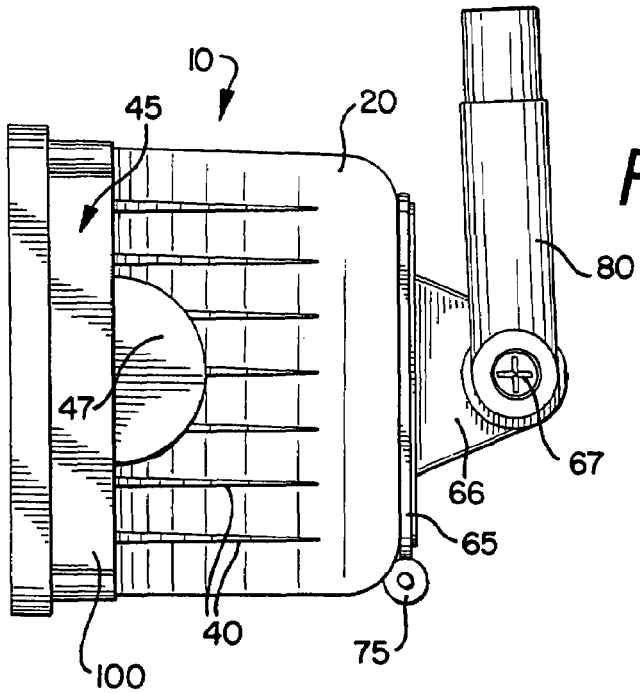
FIG. 4A
FIG. 4B
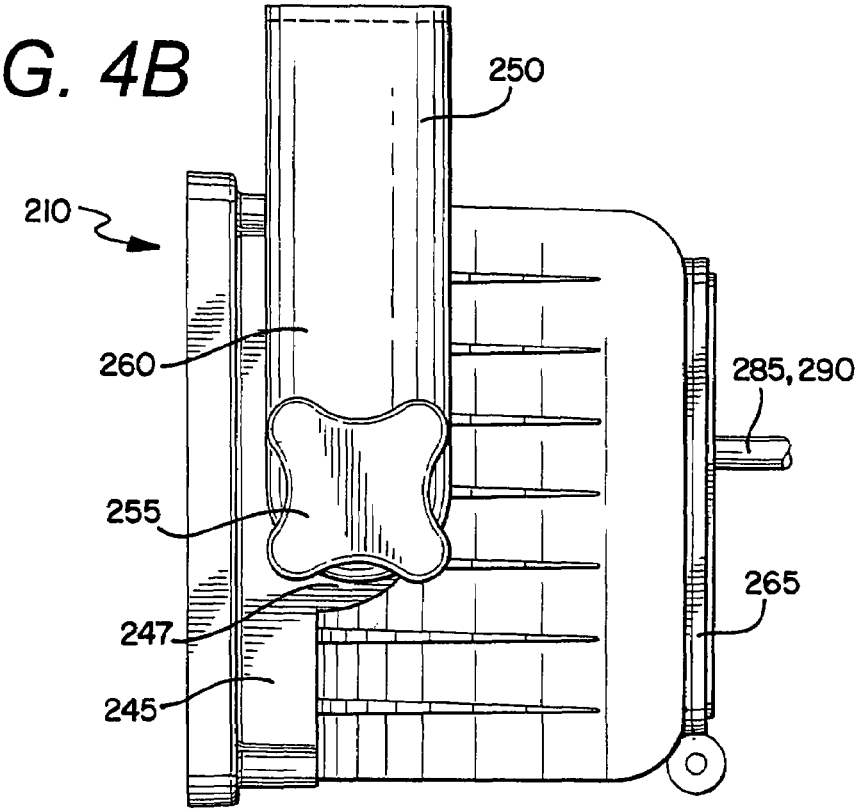

10
20
30
35
36
37
40
45
50
51
55
60
61
62
65
66
67
68
69
76
77
78
79
80
85
90
105
110
111
116
117
121
15
25
26
M

LED LIGHT FIXTURE WITH INTERNAL POWER SUPPLY

CROSS-REFERENCE TO RELATED APPLICATION

N/A

FEDERALLY SPONSORED RESEARCH OR DEVELOPMENT

N/A

TECHNICAL FIELD

The invention relates to a durable light fixture with improved thermal management properties to ensure reliable operation. More specifically, the light fixture includes a light engine featuring an arrangement of light emitting diodes (LEDs), a rugged housing, an internal power supply removably embedded within the housing, and an openable rear cover that provides access to the embedded power supply.

BACKGROUND OF THE INVENTION

Light fixtures suitable for commercial use, such as in or around building and commercial facilities, are typically designed to be durable since they can be struck or damaged during business operations. To provide this durability, existing light fixtures typically have substantial housings that protect the light source. Most existing commercial light fixtures utilize fluorescent bulbs, halogen bulbs, mercury vapor lamps, or metal halide lamps as the light source. However, these existing commercial fixtures suffer from a variety of limitations, including but not limited to high cost, low efficiency, high power consumption and/or poor light output quality. Thus, the overall appeal of existing commercial fixtures is limited, and will further erode as energy costs (and the related operating costs) continue to increase.

The present invention is provided to solve these limitations and to provide advantages and aspects not provided by conventional light fixtures. A full discussion of the features and advantages of the present invention is deferred to the following detailed description, which proceeds with reference to the accompanying drawings.

SUMMARY OF THE INVENTION

The present invention is directed to a light fixture that includes an LED light engine, which by design, is energy efficient and provides high quality light output. The inventive light fixture includes a rugged housing and an internal power supply that is thermally isolated while residing within the housing. Positioning the power supply within the housing minimizes the opportunity for incurring damage to the power supply. This is of particular importance when the light fixture is configured for use in high-traffic commercial or industrial applications, such as warehouses, loading docks or shipping/receiving areas, where the light fixture is prone to be stricken by forklifts and other large objects. While an internal power supply enjoys a reduced chance of being damaged, the power supply is susceptible to failure from heat generated by the light engine. The light fixture includes several novel heat management features designed to thermally isolate the power supply in order to reduce the risk of failure and thereby increase the reliability of the light fixture.

According to an aspect of the invention, light fixture includes a light engine assembly, a rugged housing, and an internal power module connected within a rear receptacle of the housing. The power module includes a power supply, a box, and a cover that enclose the power supply. The housing also includes an arrangement of fins extending from a main body portion of the housing and that dissipate heat. During operation, heat generated by the light engine is transferred along a flow path through the main body portion and the fins for dissipation to ambient.

According to another aspect of the invention, the light engine comprises a printed circuit board (PCB), a plurality of LED modules, and a lens extending outward from each module. Each module comprises a LED and a zener diode, which results in "bypass" circuitry to prevent catastrophic failure of the light engine. The light engine further comprises a heat transfer element, such as a thermal pad, positioned between the circuit board and the housing. The modules are divided into multiple groups, where each group includes multiple modules. Within each group, the modules are serially arrayed, and the groups are parallel to each other to facilitate current sharing from the power supply.

For a more complete understanding of the present invention, its operating advantages and the specific objects attained by its uses, reference should be had to the accompanying drawings as well as the descriptive matter in which there is illustrated and described the preferred embodiment of the present invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the light fixture of the invention;

FIG. 2 is a perspective view of the light fixture, showing the rear cover in the open position to expose a box that receives a power supply;

FIG. 3 is a top view of the light fixture, showing a power module received within a receptacle defined by an array of fins;

FIG. 4A is an end view of the light fixture;

FIG. 4B is an end view an alternate embodiment of the light fixture, showing a mounting bracket coupled to the fixture housing;

DESCRIPTION OF THE PREFERRED EMBODIMENT

Figure 5:
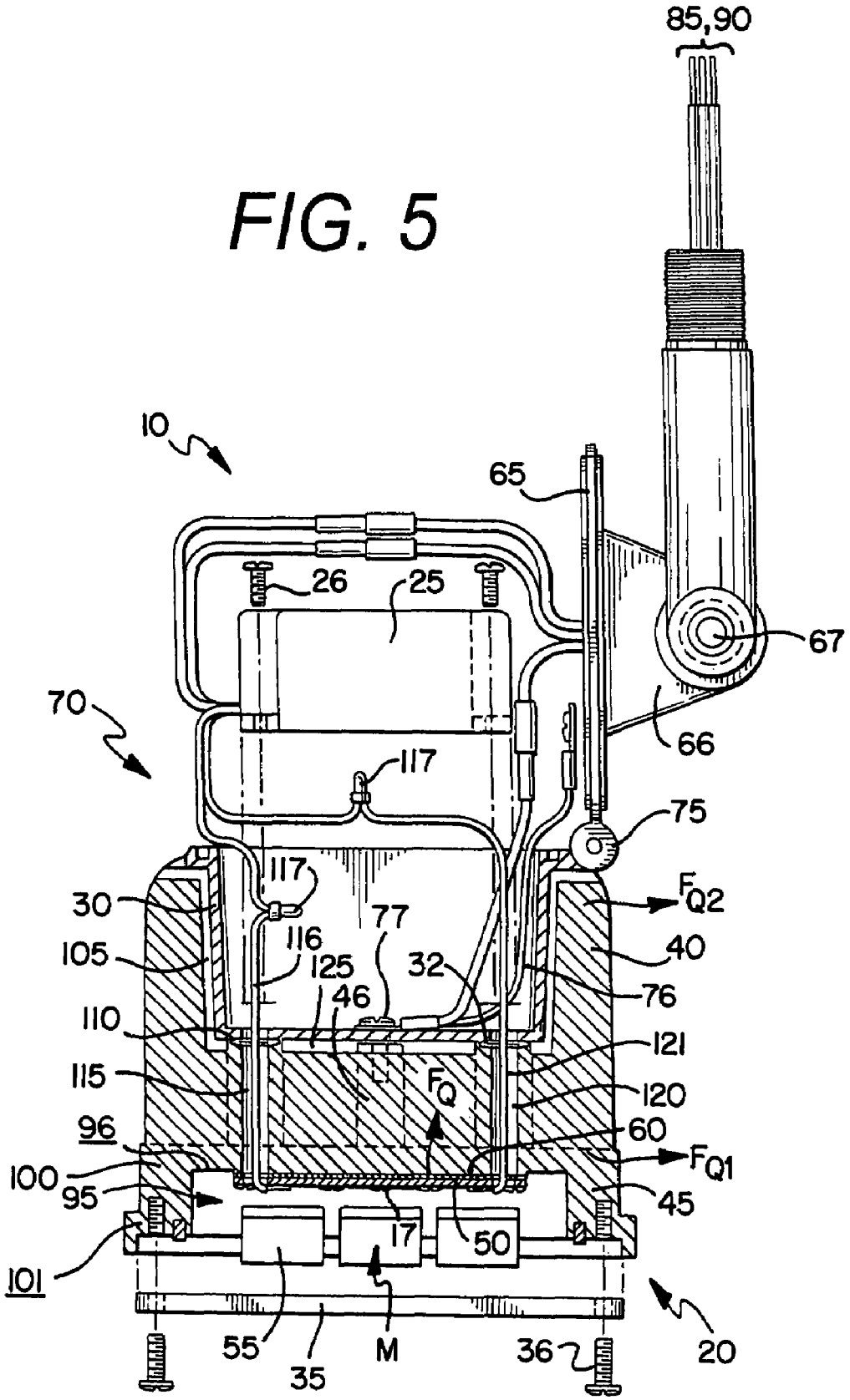
FIG. 5 is a cross-section of the light fixture, showing the cover in the open position and the power supply exploded from the power supply box.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated FIGS. 1-9 show a first embodiment of a light fixture 10 of the present invention. The light fixture 10 includes a light engine assembly 15 featuring an arrangement of light emitting diodes (LEDs) 17, a rugged housing 20, an internal power supply 25 removably embedded within a box 30 of the housing 20, wherein the box 30 encloses the power supply 25 within the housing 20. This embodiment of the light fixture 10 is configured for use in commercial or industrial applications, such as loading docks or receiving areas. In these high-traffic areas, conventional light fixtures, which include an externally-mounted power supply, are prone to being struck by forklifts and other large objects. By positioning the power supply 25 within the housing 20, the inventive fixture 10 reduces both (a) the overall dimensions of the light fixture 10, and (b) the incidence of damage to the power supply 25. However, the embedded power supply 25 then becomes susceptible to failure from heat generated by the light engine 15. To combat this, the light fixture 10 includes several heat management components, including the housing 20 itself, to dissipate heat from the light engine 15 and to thermally isolate the power supply 25. Individually and collectively, the heat management components increase the reliability of the light fixture 10, including the light engine 15 and the power supply 25.

The light fixture 10 further includes a rectangular lens 35 secured to the housing 20 by a plurality of fasteners 36, and a gasket 37. The housing 20 includes an arrangement of external fins 40 that help the housing 20 dissipate heat generated by the light engine 15. The fins 40 extend from a main body portion 45 of the housing 20 which includes that portion of the housing 20 that engages the lens 35 and the light engine 15. The main body 45 includes a curvilinear protrusion 47 proximate side fins 40 (see FIGS. 1-4A). The light engine 15 comprises a printed circuit board (PCB) 50, a plurality of LED modules M, and a lens 55 extending outward from each module M. The light engine 15 further comprises a heat transfer element 60, for example a thermal pad 61, positioned between the rear surface of the circuit board 50 and the housing 20. The circuit board 50 and the heat transfer element 60 are secured to the housing 20 by at least one fastener 51. In contrast to existing lighting devices that employ LEDs, the present light fixture 10 does not require a reflector(s) to focus or disperse the light pattern generated by the LEDs. As a result, the dimensions of the housing 20 are reduced while still allowing for the internal power supply 25. Although not shown, the housing's main body 45 may include a vent to reduce fogging of the lens 35 in harsh or damp operating environments.

As mentioned above, the housing 20 also includes a power supply box 30 that receives the power supply 25. Preferably, the power supply 25 is of the universal input, constant current output and switching variety. The box 30 includes a cover segment 65 that is operably connected to the box 30 to allow for movement of the cover 65 and to provide for insertion and removal of the power supply 25. Thus, the power supply 25 can be repaired or replaced when the light fixture 10 malfunctions. FIG. 2 depicts the light fixture 10 in an open position P1, wherein the rear cover 65 is opened to expose the power supply 25. Since the cover 65 is operably connected to the box 30 to enclose the power supply 25, these three components define a power module 70 that is thermally isolated from the heat generated by the light engine 15 and dissipated by the housing 20. A hinge 75 is formed between the box 30 and the cover 65 to allow for pivotal movement of the cover 65. Alternatively, the cover 65 is operably connected to the box 30 by alternate securing means, such as a pin and socket arrangement or sliding channel arrangement. A tether 76, secured by fasteners 77 and washers 78, extends between the box 30 and the cover 65 to prevent over-rotation of the cover 65. Fasteners 79 extend through the upper portion of the cover 65 to further secure the cover 65 to the box 30. The rear cover 65 further includes an elongated arm 80 that is used to mount the light fixture 10 to a support surface. The arm 80 is adjustably connected to a sub-base 66 of the rear cover 65 by an adjustment screw 67 and an O-ring 68. The arm 80 is tubular to allow for the passage of electrical leads, namely the main power leads 85 and a ground lead 90. Because the power supply 25 is internal to the housing 20, the rear cover 65 includes an opening 69 that allows for the passage of the power and grounds leads 85, 90 for connection to the power supply 25.

Figure 6:
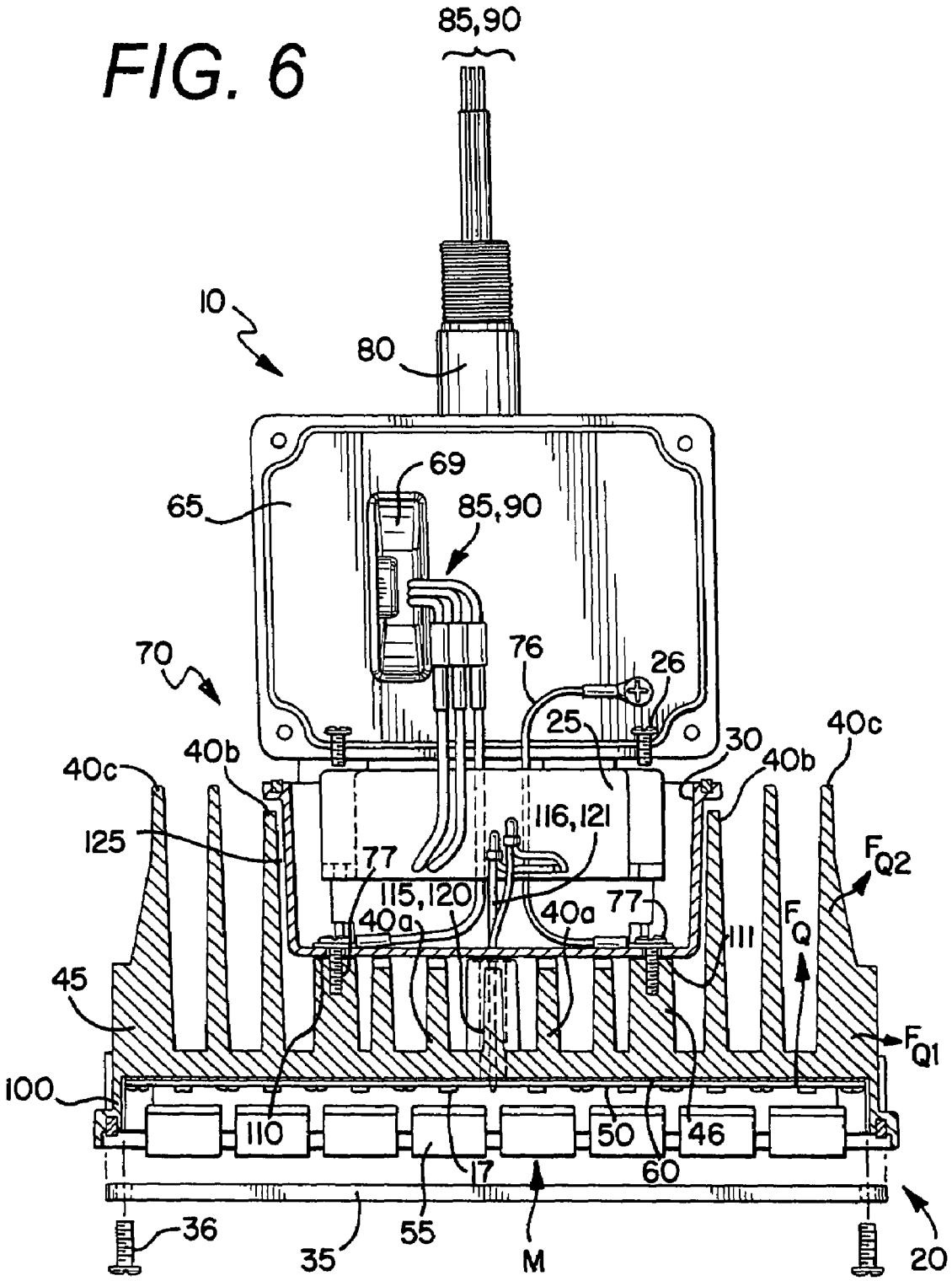
FIG. 6 is a cross-section of the light fixture, showing the cover in the open position and the power supply exploded from the power supply box.

As shown in the cross-section views of FIGS. 4A and 5, the main body 45 has an inwardly extending receiver 95 defined by a flange 100. The receiver 95 provides a primary mounting surface 96 for the light engine 15, while the flange 100 provides a secondary mounting surface 101 for the lens 35. The heat transfer element 60 is positioned between a rear surface of the circuit board 50 and the secondary mounting surface 101 to facilitate heat transfer. The array of fins 40 extending outward from the housing 20 body defines a rear receptacle or pocket 105, that is substantially rectangular, that receives the box 30 and the power supply 25. Fasteners 26 secure the power supply 25 to the box 30. Due to the positioning of the box 30 and the power supply 25, there are different sized fins 40 (see FIG. 6)—the inner fins 40*a* have the shortest length, the intermediate fins 40*b* have a longer length, and the outer fins 40*c* have the longest length (see FIG. 6). In one embodiment, the power supply box 30 resides substantially within the rear receptacle 105 and the cover 65 is external to the receptacle 105 (see FIG. 4). Preferably, the width of the box 30 (and the power supply 25) is less than the width of the housing 20. The box 30 is secured to at least one boss 46 (see FIG. 6) extending rearward from the housing main body 45 by the fastener 77 and the washer 78. As shown in FIG. 6, the boss has a length that exceeds the length of the inner fins 40*a* whereby the box 30 is offset from the inner fins 40*a* and within the intermediate fins 40*b*. Preferably, at least one thermal insulator 110, for example elastomeric or nylon O-rings 111, or an insulating thermal sheet, is placed between the main the boss 46 and the power supply box 30 to thermally isolate the power supply 25. The main body 45 also includes a first internal passageway 115 that accommodates a first supply lead 116 extending between the light engine 15 and the power supply 25, and a second internal passageway 120 that accommodates a second supply lead 121 extending between the light engine 15 and the power supply 25. Couplers 117 may be used to electrically connect distinct segments of the supply leads 115, 120. The thermal insulator 110 that resides between the boss 46 and the box 30 allows for the passage of the supply leads 116, 121.

Referring to the top view of FIG. 3 and the cross-section views of FIGS. 5 and 6, the fins 40 and the power module 70 provide the housing 20 with a distinct configuration. When the box 30 is secured to the bosses 46, a cavity or void 125 is defined between (1) the fins 40*a* and the box 30 and (2) between the fins 40*b* and the side walls 31 of the box 30. This cavity 125 and the insulators 110 help to thermally isolate the box 30 and the internal power supply 25. Thus, the power supply box 30, the power supply 25 and the cover 65 are spaced from the main body 45 to define the cavity 125. As mentioned above, the main power leads 85 extend through the arm 80 and the cover opening 69 to the power supply 25. The ground lead 90 also extends through the arm 80 but then is secured to the boss 46 by the fastener 77. Similarly, the tether 76 that prevents over-rotation of the cover 65 is secured to the other boss 46. The first and second supply leads 116, 121 extend from the power supply 25 through the passageways 115, 120 to the circuit board 50 to energize the LED modules M of the light engine 15. Specifically, the first and second supply leads 116, 121 extend through the openings 32 in the power supply box 30 and the first and second passageways 115, 120, respectively. From there, the first and second supply leads 116, 121 extend through openings 62 in the thermal pad 61 and then connect with the circuit board 50. Preferably, the first supply lead 116 is electrically connected to a first point P1 of the circuit board 50 and the second supply lead 121 is electrically connected to a second point P2 of the circuit board 50.

An alternate embodiment of the fixture 10, denoted as fixture 210, is shown in FIG. 4B. There, the fixture 210 includes a mounting bracket 250 moveably coupled to the housing 220 and which eliminates the support arm 80. Instead of extending through a support arm, the power and ground leads 285, 290 extend through the rear cover 265 for connection to the internal power supply 25. The mounting bracket 250 includes an adjustable fastener 255 extending through each side segment 260 of the bracket 250, and that that allows for pivotal movement of the bracket 250 with respect to the housing 220. The fastener 255 is received by openings in the curvilinear protrusion 247 near the main body portion 245. In the 90 degree position of FIG. 4B, the bracket 250 is configured to allow the fixture 210 to be mounted to an overhead surface, such as a ceiling or horizontal support, whereby the fixture 210 is vertically suspended. In a 180 degree position, the bracket 250 is configured to allow the fixture 210 to be mounted to a wall or vertical support, whereby the fixture 210 extends outwardly from the wall.

As mentioned above, the light engine assembly 15 comprises the printed circuit board 50 (PCB), at least one LED module M, the heat transfer element 60, and at least one lens 35 extending outward from each module M. In one embodiment, the circuit board 50 is thermal clad, meaning a thin thermally conductive layer bonded to an aluminum or copper substrate, to facilitate heat transfer from the LED modules M through the circuit board 50 and to the housing main body 45 and the fins 40 for dissipation. Alternatively, the circuit board 50 is fabricated from fiberglass material (known as a FR-4 board) and includes thermal vias or pathway to permit heat transfer through the circuit board 50. The thermal pad 61 is a heat transfer element 60 with a high thermal conductivity rating to increase the heat transfer from the circuit board 50 to the housing 20. Preferably, the dimensions of the thermal pad 61 substantially correspond to the dimensions of the circuit board 50 for surface area coverage and more effective heat transfer. The thermal pad 61 and the circuit board 50 each have a rectangular configuration. Further, the openings 62 in the thermal pad 60 are aligned with the connection points P1, P2 for the first and second supply leads 116, 121. In another embodiment, the thermal pad 62 is omitted and the printed circuit board 50 directly contacts the mounting surface 96. In yet another embodiment, the thermal pad 62 is replaced by thermal grease or gel, which is a specially formulated substance that increases heat transfer. The thermal grease may be silicone-based, ceramic-based with suspended ceramic particles, or metal-based with metal particles (typically silver) suspended in other thermally conductive ingredients.

Figures 7, 8:
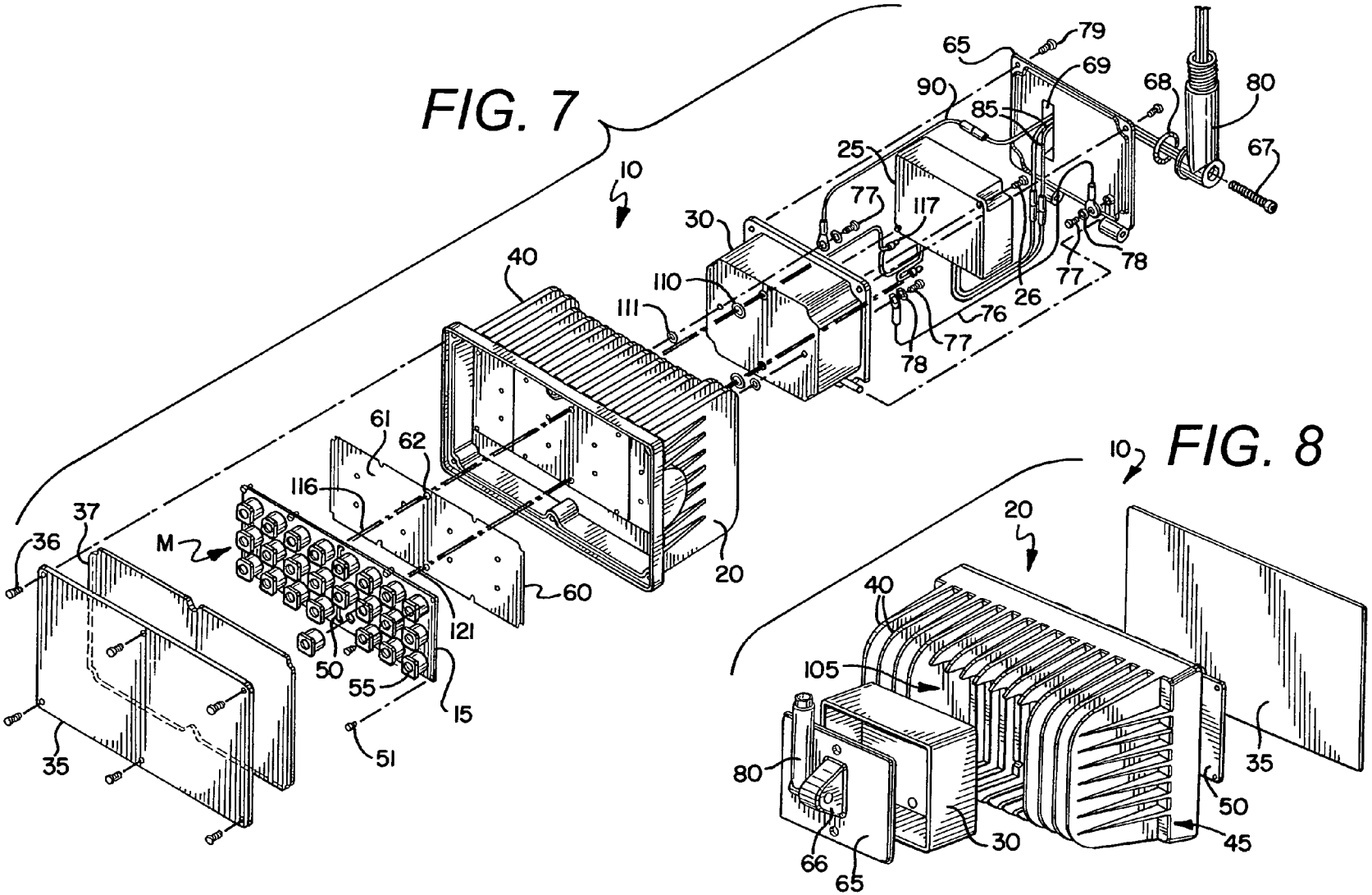
FIG. 7 is an exploded view of the light fixture, showing the various components of the light fixture including a light engine, a housing, a power supply box and a power supply.
FIG. 8 is a partial exploded view of the light fixture.

Referring to the schematic of FIG. 7, a first embodiment of the light engine 15 has eighteen (18) light modules M1-M18 that are electrically and mechanically coupled to the circuit board 50. In an alternate embodiment (not shown), the light engine 15 includes twenty-four (24) light modules. The light modules M1-M18 are top-mounted on the circuit board 50 and are electrically interconnected by a copper trace 52. Each light module M comprises a LED 17 and a zener diode 18, which results in "bypass" circuitry to prevent catastrophic failure of the light engine 15. The LED 17 is mounted to the board 50 to provide an angle of emission ranging from 75-100 degrees, and preferably 80-90 degrees. In one embodiment, the LED 17 is white and has a color rendition index (which is a measurement of the LED's ability to show true color) of greater than 80 and a color temperature (which is a measurement of warmth or coolness of the light produced by the LED) of roughly 2700-8200 degrees Kelvin (K). In the 2750K, 3000K, 3500K and 4200K configurations, the LEDs 17 have a warm white quality, and in the 5100K, 6500K and 7000K configurations, the LEDs 17 have a cool white quality. The modules M1-M18 are divided into three groups G1-G3, where each group includes six (6) modules. Within each group G1-G3, the modules M are serially arrayed, and the groups G1-G3 are parallel to each other to facilitate current sharing from the power supply 25. The current sharing provided by the three groups G1-G3 promotes uniform light brightness between the groups G1-G3 and the modules M therein, and maintains constant color temperature of the light produced by the LEDs 17.

Current is supplied from the power supply 25 to the modules M1-M18 by the first or positive supply lead 116, which is electrically connected to the circuit board 50 at the point P1. From there, current is supplied to the primary modules M1, M7 and M13, in each of the three module groupings G1, G2, G3 by supply copper traces 53. Here, each group G1-G3 comprises six modules M, however, each group could comprise a different number of modules M. During operation, current flows through the components of the primary modules M1, M7 and M13 and illuminates the LED 17 therein. Current exits the primary modules M1, M7 and M13 along the interconnect trace 52 and proceeds into the secondary modules M2, M8 and M14 to illuminate the LED 17 therein. Current exits the second modules M2, M8 and M14 along the interconnect trace 52 and proceeds into the tertiary modules M3, M9 and M15 to illuminate the LED 17 therein. This current flow sequence continues until exiting the last modules M6, M12 and M18 wherein current flows back to the power supply 25 via return copper traces 54 linked to the second or negative supply lead connected at the point P2.

As briefly mentioned above and as shown in FIG. 9, when the LED 17 modules M1-M18 are serially arrayed, each module M includes a zener diode electrically connected to the LED 17 by a copper trace. In the event the module M includes multiple LEDs 17, then a zener diode is electrically connected to each LED 17. The zener diode and the LED 17 combine to form a "bypass" circuit to prevent catastrophic failure of the light engine 15. The zener diode 18 provides an alternate electrical path, where the diode 18 provides high resistance (essentially an open-circuit) to voltage and current transmission when the LED 17 is operating normally. A Zener diode 18 is a type of diode 18 that permits current to flow in the forward direction like a normal diode, but also in the reverse direction if the voltage is larger (not equal to, but larger) than the rated breakdown voltage known as the "Zener voltage". In the event the LED 17 malfunctions or fails, the zener diode 18 provides an alternate current path to complete the circuit for that particular module M and the remaining modules M of the light engine 15. In this situation, the voltage drop across the diode 18 is similar to the voltage drop across a properly operating LED 17. Although the diode 18 has no illumination characteristics, it provides an alternate or bypass electrical path to allow the other modules M to remain operational. For example, the fixture 10 has eighteen modules M1-M18, each having a zener diode 18 associated with a LED 17. Assuming the LED 17 in the third module M3 fails, current continues to flow in the bypass path provided by the zener diode 18 and only that particular LED 17 will not be illuminated. As a result, the remaining modules M1, M2 and M4-15 will continue to operate with their respective LED 17 being illuminated. In this manner, the failure of one LED 17 will only affect that particular module M and the remaining modules M in the group G will continue to operate as intended. Without the bypass provided by the zener diode 18, an entire group of LEDs 17 will lose illumination when just one LED 17 therein fails or malfunctions. In addition to bypass operation, the zener diode 18 helps service technicians to identify a faulty module M, since only that module M will be dark while the other modules M are illuminated. In this manner, replacement and/or upgrade of the modules M is made more efficient and less time consuming.

Figure 9:
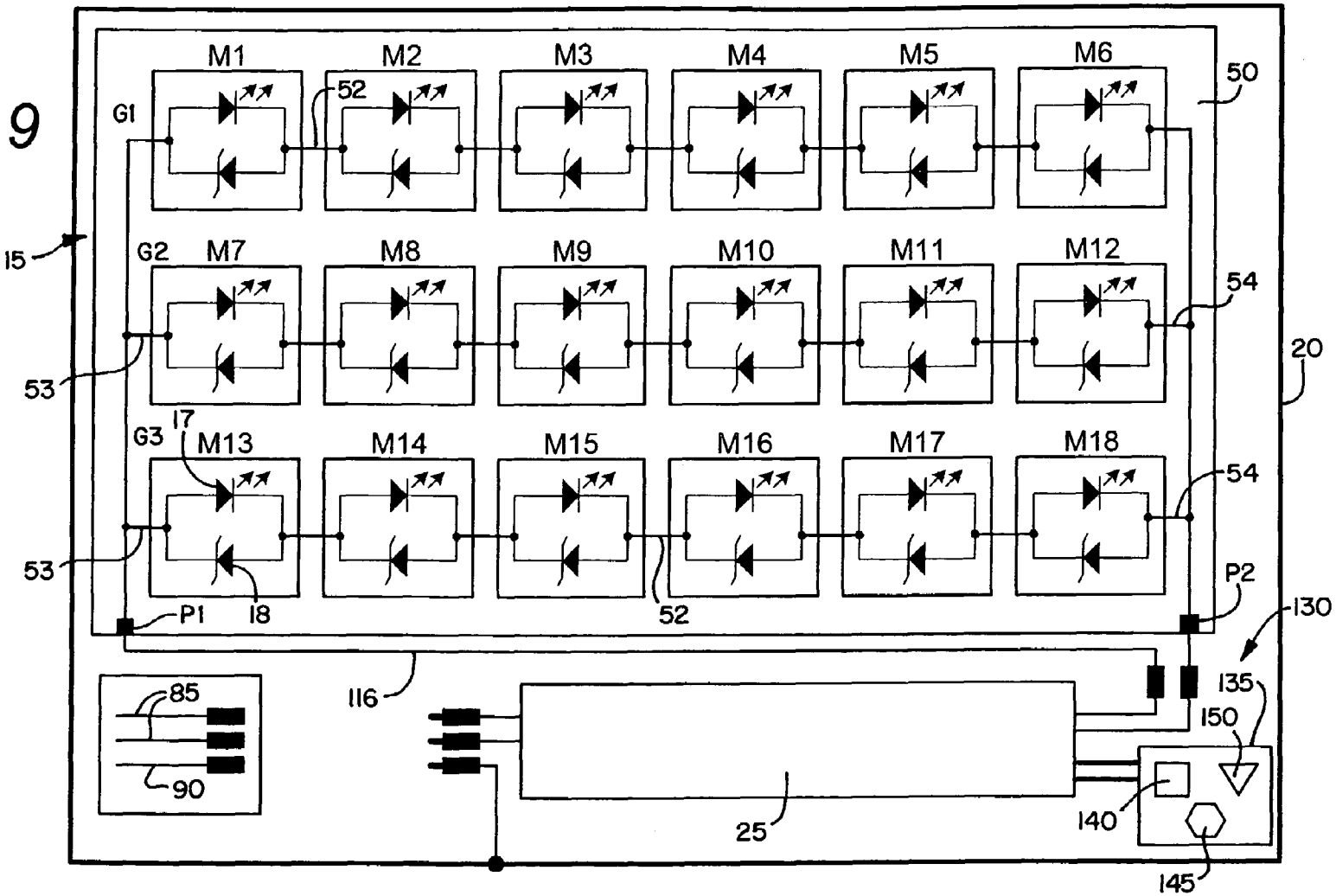
FIG. 9 is an electrical schematic of the light engine of the light fixture, showing the various LED modules and their components.

Referring to FIG. 9, the fixture 10 includes a wireless module 130, primarily a radio frequency control unit 135, that allows for remote control of the fixture 10. The radio frequency control unit 135 can be factory assembled into the housing 20 as original equipment, or added to the housing 20 in the field by a service technician. In general terms, the radio frequency control unit 135 allows an operator to remotely turn on, turn off, or adjust the fixture 10 or group of fixture 10*s* to any desired brightness level. The remote interaction resulting from the control unit 135 provides a number of benefits to the fixture 10, including longer operating life for the components, lower energy consumption, and lower operating costs.

The radio frequency control unit 135 comprises a number of components including a transceiver 140 (or separate receiver and transmitter components), an antenna 150, and control interface 145 for the power supply 25. The control interface 145 includes a connector containing input signals for providing raw power to the control unit 135, as well as output signals for controlling the power supply 25 itself. In operation, the control unit 135 interacts with the power supply 25 to allow an operator to power on, power off, or dim the brightness of the fixture 10. To ensure reception of the operating signals, the control unit 135 utilizes an embedded antenna 150, or an external antenna 150 coupled to the housing 20 for better wireless reception. The radio frequency control unit 135 can receive commands from a centralized controller, such as that provided by a local network, or from another control module positioned in a fixture 10 in close proximity. Thus, the range of the lighting network could be extended via the relaying and/or repeating of control commands between control units 135.

In a commercial facility or building having multiple fixtures 10, each fixture 10 may be assigned a radio frequency (RF) address or identifier, or a group of fixtures 10 are assigned the same RF address. An operator interfacing with a lighting control network can then utilize the RF address to selectively control the operation and/or lighting characteristics of all fixtures 10, a group of fixtures 10, or individual fixtures 10 within the store. For example, all fixtures 10 having an RF address corresponding to a specific function or location within the store, such as the loading dock or shipping point, can be dimmed or turned off when the store is closed for the evening. The operator can be located within the store and utilize a hand held remote to control the group of fixtures 10 and/or individual fixture 10. Alternatively, the operator may utilize a personal digital assistant (PDA), a computer, or a cellular telephone to control the fixtures 10. In a broader context where stores are located across a broad geographic region, for example across a number of states or a country, the fixtures 10 in all stores may be linked to a lighting network. A network operator can then utilize the RF address to control: (a) all fixtures 10 linked to the network; (b) the fixtures 10 on a facility-by-facility basis; and/or (c) groups of fixtures 10 within a facility or collection of facilities based upon the lighting function of the fixtures 10.

A centralized lighting controller that operably controls the fixtures 10 via the control units 135 can be configured to interface with an existing building control system or lighting control system. The central lighting controller may already be part of an existing building control system or lighting control system, wherein the fixture 10 and the control unit 135 are added as upgrades. The radio frequency control unit 135 could utilize a proprietary networking protocol, or use a standard networking control protocol. For example, standard communication protocols include Zigbee, Bluetooth, IEEE 802.11, Lonworks, and Backnet protocols.

As mentioned above, the light fixture 10 includes several heat management components, to efficiently dissipate heat generated by the modules M1-M18 and to thermally isolate the power supply 25 in order to reduce its risk of failure and increase the reliability of the fixture 10, including the light engine 15. Efficient heat dissipation from the light engine 15 allows for more forward current applied to the LEDs 17, which ensures consistent light output from the modules M1-M18. In addition, minimizing temperature of the LEDs 17 lessens the change in the color wavelength, since the color wavelength increases with temperature. The heat management components include the fins 40 arrayed about the aluminum housing 20, the thermal pad 61, and the void 125 between the power module 70 and the main body 45. During operation and as shown in FIGS. 5 and 6, heat is generated by the modules M1-M18 and then is transferred along a flow path $F_Q$ for dissipation from the housing 20. Specifically, heat generated by the modules M is transferred, via conduction, along the flow path $F_Q$ through the circuit board 50 and the thermal pad 61 to the main body 45, which acts as a heat sink. A first quantity of heat is dissipated to ambient through convection from the main body 45 as first flow path $F_{Q1}$, and a second quantity of heat flows along a second flow path $F_{Q2}$ into the fins 40 for convection to ambient. Due to the configuration of the fins 40 and the main body 45, the quantity of heat dissipated by the second flow path $F_{Q2}$ exceeds the heat dissipated by the fist flow path $F_{Q1}$. There is a temperature gradient from the main body 45 to the fins 40 and the gradient effectively draws heat from the modules M1-M18 through the main body 45 and the fins 40 to ensure effective heat management and extended operational life of the fixture 10.

The cavity 125 between the main body 45 and the power module 70 exposes the fins 40 proximate the box 30 to cooling air for convective heat transfer, which prevents a significant quantity of heat from transferring to the power supply 25. While a small quantity of heat may be transferred to the bosses 46, the insulator 110 (such as the elastomeric ring 11) minimizes any further heat transfer to the box 30 and the power supply 25. In some situations, a small amount of heat may eventually be transferred to the power supply 25 via the fasteners 77; however, due to the heat management components of the fixture 10, that amount is relatively low and should not compromise the operation and durability of the power supply 25. As an example of the fixture's heat management capabilities during steady state operation, the LED 17 junction temperature at the circuit board 50 was measured at 55° C., the housing 20 body temperature was 45° C., the ambient temperature was 25° C., and the power supply 25 temperature was 53° C. Significantly, the LED 17 junction temperature of 55° C. is far below the 85° C. threshold where initial degeneration begins and the 125° C. level where failure occurs, and the power supply 25 temperature of 53° C. is below the 70° C. threshold where failure may occur. Thus, the fixture's ability to effectively manage the heat generated by the modules M1-M18 provides a number of benefits, including but not limited to, continuous and reliable operation of the light engine 15 and the power supply 25; consistent, high quality light produced by the modules M1-M18; and, efficient operation which leads to lower power consumption and operating costs.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A light fixture comprising:

a housing having a main body portion and a plurality of fins that extend from the main body portion, wherein the fins define a receptacle;

a light engine assembly mounted to the main body portion, the light engine having a plurality of light modules comprising a LED and a zener diode mounted to a printed circuit board, the light engine further having a heat transfer element positioned between the circuit board and the body portion; and, a power module residing within the receptacle and connected to the main body portion, the power module including a box, an internal power supply, and an openable cover that encloses the power supply.

2. The light fixture of claim 1, wherein the main body portion has at least one internal passageway that receives supply leads extending between the power supply and the circuit board.

3. The light fixture of claim 1, wherein the housing has a flange that defines an inwardly extending receiver that provides a primary mounting surface for the light engine.

4. The light fixture of claim 3, wherein the flange provides a second mounting surface for a lens.

5. The light fixture of claim 1, wherein the heat transfer element is a thermal pad that contacts the rear surface of the circuit board.

6. The light fixture of claim 1, wherein the light modules are arranged into at least two parallel groups, and wherein the light modules within each group are serially arranged.

7. The light fixture of claim 6, wherein a pair of supply leads extend between the power supply and the circuit board, and wherein a positive supply lead supplies current to the first module of each group.

8. The light fixture of claim 1, wherein the main body portion includes at least one boss for mounting of the power module, and wherein a thermal insulator is utilized between the boss and the power module.

9. The light fixture of claim 1, wherein the cover includes an opening that receives power leads and a ground lead that connect with the power supply.

10. The light fixture of claim 9, further comprising a mounting arm, and wherein the power and ground leads extend through the mounting arm and into the cover.

11. A LED light fixture comprising:

a housing including a body portion and a plurality of fins extending rearward from the body portion, the fins defining a receptacle;

a light engine assembly mounted to the body portion, the light engine having a plurality of light modules comprised of a LED and a zener diode mounted to a printed circuit board; and, a power module residing within the receptacle, the power module including a power supply residing within an openable box within the receptacle.

12. The LED light fixture of claim 11, wherein first and second supply leads extend from the power supply through the body portion for connection with the circuit board.

13. The LED light fixture of claim 12, wherein the body portion includes a first passageway extending from the receptacle to the light engine, and wherein the first supply lead extends through the first passageway and is electrically connected to the circuit board.

14. The LED light fixture of claim 13, wherein the body portion includes a second passageway extending from the receptacle to the light engine, and wherein the second supply lead extends through the second passageway and is electrically connected to the circuit board.

15. The LED light fixture of claim 11, wherein first and second supply leads extend from the power supply to the circuit board, and wherein the light modules are divided into at least two parallel groups of serially arranged modules.

16. The LED light fixture of claim 15, wherein current flows along the first supply lead to a primary light module of each group and illuminates the LED therein, and wherein current exits the primary light modules along an interconnect trace.

17. The LED light fixture of claim 16, wherein current flows from the interconnect trace into a secondary light module to illuminate the LED therein, and wherein current exits the second light module along an interconnect trace.

18. The LED light fixture of claim 11, wherein the light engine assembly includes a thermal pad that is positioned between the circuit board and the body portion.

19. The LED light fixture of claim 11, further comprising a mounting arm extending from a cover segment of the box of the power module, wherein electrical leads extend along the mounting arm and through an opening in the cover for connection to the power supply.

20. The LED light fixture of claim 19, wherein the cover is pivotally connected to the box to allow an operator to access the power supply.

21. A LED light fixture comprising:

a housing including a flange, an internal receiver, a frontal lens and an array of fins extending rearward from the flange to define a rear receptacle that extends forward towards the flange, the housing further including a rear cover that encloses the rear receptacle;

a light engine assembly mounted to the receiver, the light engine having a plurality of light modules wherein each module includes both a LED mounted to a printed circuit board and an optical lens extending from the printed circuit board;

a power supply residing within the rear receptacle and enclosed by the cover; and, wherein during operation, heat generated by the LEDs passes through the circuit board and then said heat is dissipated by the array of fins without the use of a fan.

22. The LED light fixture of claim 21, wherein the array of fins includes a first set of fins with a first fin length and a second set of fins with a second fin length, wherein the first fin length exceeds the second fin length.

23. The LED light fixture of claim 21, wherein the housing has an overall length and a mid-length, and wherein the array of fins has a length that exceeds said mid-length.

24. The LED light fixture of claim 21, further comprising a thermal pad residing between the receiver and the printed circuit board, wherein both the thermal pad and the printed circuit board have at least one opening that receives a lead extending between the power supply and the printed circuit board.

25. The LED light fixture of claim 21, further comprising a mounting bracket having opposed side segments that are secured to opposed sides of the housing rearward of the flange.

26. The LED light fixture of claim 21, wherein the frontal lens is secured to the flange by a plurality of fasteners arranged at the periphery of both the frontal lens and the flange.

27. The LED light fixture of claim 21, wherein each module of the light engine includes a zener diode in a one to one parallel relationship with the LED.

28. The LED light fixture of claim 21, wherein during steady state operation of the fixture in 25 C ambient environment, the LED junction temperature at the printed circuit board is approximately 55 C and the housing body temperature is approximately 45 C.

* * * * *